US009051746B2

(12) United States Patent
Rogers

(10) Patent No.: US 9,051,746 B2
(45) Date of Patent: Jun. 9, 2015

(54) INTEGRATED PLANK AND TOEBOARD SYSTEM

(75) Inventor: Peter J. Rogers, Barrie (CA)

(73) Assignee: Athos Construction Products Inc.

( * ) Notice: Subject to any disclaimer, the term of this patent is extended or adjusted under 35 U.S.C. 154(b) by 1110 days.

(21) Appl. No.: 12/399,160

(22) Filed: Mar. 6, 2009

(65) Prior Publication Data

US 2010/0224447 A1 Sep. 9, 2010

(51) Int. Cl.

| | |
|---|---|
| ***E04G 5/08*** | (2006.01) |
| ***E04G 7/28*** | (2006.01) |
| *E04G 5/00* | (2006.01) |

(52) U.S. Cl.

CPC ... *E04G 7/28* (2013.01); *E04G 5/08* (2013.01)

(58) Field of Classification Search

USPC ..... 182/113, 222, 119, 112, 223

See application file for complete search history.

(56) References Cited

U.S. PATENT DOCUMENTS

| | | | | | |
|---|---|---|---|---|---|
| 2,851,311 | A | * | 9/1958 | Gibbs | 182/222 |
| 3,093,216 | A | * | 6/1963 | Dunham | 52/180 |
| 3,434,567 | A | * | 3/1969 | Wilkins | 182/222 |
| 3,592,145 | A | * | 7/1971 | Petry | 108/57.21 |
| 3,782,499 | A | * | 1/1974 | Fisher | 182/230 |
| 3,836,106 | A | * | 9/1974 | Gray | 248/229.26 |
| 3,844,520 | A | * | 10/1974 | Werner et al. | 248/228.3 |
| 3,848,854 | A | * | 11/1974 | De Barbieri | 256/70 |
| 3,853,203 | A | * | 12/1974 | Werner et al. | 182/113 |
| D281,106 | S | * | 10/1985 | Thomas et al. | D25/68 |
| 4,576,500 | A | * | 3/1986 | Wong | 403/49 |
| 4,869,343 | A | * | 9/1989 | Anderson | 182/113 |
| 5,279,387 | A | * | 1/1994 | Swiderski et al. | 182/27 |
| 5,555,955 | A | * | 9/1996 | D'Alessio | 182/222 |
| 5,704,449 | A | * | 1/1998 | Ono | 182/119 |
| 5,746,288 | A | * | 5/1998 | O'Neal et al. | 182/118 |
| 5,862,881 | A | * | 1/1999 | O'Brien | 182/117 |
| 5,882,136 | A | * | 3/1999 | Pyritz et al. | 403/24 |
| 6,223,857 | B1 | * | 5/2001 | Wyse | 182/222 |
| 6,976,557 | B2 | * | 12/2005 | Becker | 182/113 |
| 7,963,367 | B2 | * | 6/2011 | Wilson | 182/112 |
| 7,975,803 | B2 | * | 7/2011 | Schwoerer | 182/178.1 |

OTHER PUBLICATIONS

Definition of 'Central' Found in Action The American Heritage® Dictionary of the English Language, Fourth Edition copyright ©2000 by Houghton Mifflin Company. Updated in 2009. Published by Houghton Mifflin Company. All rights reserved.*

* cited by examiner

*Primary Examiner* — Daniel Cahn

(57) ABSTRACT

A scaffold plank and toeboard system provides a fully integrated system where toeboards are easily securable to provide perimeter protection about different working platform configurations. The scaffold advantageously includes a series of securing ports that allow male connectors of the system toeboards, or male connectors of generic toeboard securing brackets to be appropriately placed for maintaining wooden, metal or other toeboard material that is basically fabricated onsite according to the material available. The scaffold securing plank also cooperates with other equipment, guard rails, plank support intermediary ledgers etc. to use the securing ports to simplify installation and securement thereof.

8 Claims, 15 Drawing Sheets

INTEGRATED PLANK AND TOEBOARD SYSTEM

FIELD OF THE INVENTION

The present application relates to scaffold systems, and in particular, to an integrated plank and toeboard securement system.

BACKGROUND OF THE INVENTION

Scaffold safety regulations require toeboards to be used around the edge of an elevated work platform to prevent tools etc. being inadvertently dropped from a significant height. The most common scaffold systems include a toeboard arrangement that is secured to the scaffold vertical members. The toeboards can be directly secured to connectors provided on the uprights or may use specialized connectors provided on the uprights to locate the toeboards. In one system, steel toeboards are fixed in place by locating them behind wedge bracket connectors that fix the ledgers of the scaffold system to the vertical uprights. In this arrangement, the toeboard system is essentially independent of the plank system. A major disadvantage of this arrangement is that the planks defining the work platform do not always fit well on the ledgers, and there is a possibility for a gap to be present between the toeboard and the planks. Some regulations require that this gap be not greater than one inch or the scaffold may be deemed as unsafe.

It is also known in the industry to use commonly available steel channels (typically sold as metal studding) that are fixed to the scaffold vertical members by clamps or are sometimes merely wired to the vertical uprights. It is also common to use wooden toeboards that are again connected to the scaffold vertical uprights by wire or nailed to the scaffold planks.

In the UK, toeboards are often a scaffold plank that is used on edge and secured to the vertical uprights using clips or clamps, or perhaps nailing them in place.

The above prior art toeboard systems operate essentially independent from the planks as the toeboards are all secured by attaching them to the vertical posts of the scaffold.

Toeboard systems in general are considered by the industry as a necessity to meet the legal requirements, but not considered a major component of a system. For these reasons, the expense of a fully integrated toeboard system is not popular, and for cost reasons, wood or other low cost materials that are readily available are tied or otherwise secured to the uprights.

A problem exists given that scaffold frames are of a predetermined width, typically five feet in North America, and require approximately six planks to fully deck the frame. It is also known to use two 19 inch wide aluminum plywood planks if only partial decking is used. Unfortunately, with partial decking the vertical uprights are not in the appropriate location for securement of the toeboards and a further securing arrangement must be designed on site.

One system that is a major departure from the above is shown in Canadian Patent Application 2,210,952 where a toeboard system is designed for securement to an end connector of a scaffold plank. The scaffold plank system has specialized corner connectors for engaging a side rail and engaging an end cap of the scaffold plank. This corner connector includes a port for receiving a projecting securing member of a toeboard. The toeboard includes these securing members at opposite ends thereof, and are of the same length as the plank. This type of toeboard plank system has not been widely accepted in the industry. With this system, the toeboard is fixed to the securement locations at opposite ends of a scaffold plank, and the system requires dedicated planks and cooperating toeboards. For many owners of scaffolding, the additional cost and equipment cannot be justified.

The present invention seeks to overcome a number of difficulties associated with toeboard systems and provide a more cost effective solution and flexible system.

SUMMARY OF THE INVENTION

A scaffold plank according to the present invention comprises a top surface, opposed side rail portions extending the length of the plank and opposed end caps joining the side rail portions and supporting the top surface at the ends thereof. The side rail portions extend downwardly below and support the top surface along lateral edges thereof. The top surface above each rail portion includes a series of lateral securing slots intermediate the length of the plank that pass through the top surface to allow engagement with the underlying rail portion. The lateral securing slots cooperate with toeboard mounting brackets to secure a toeboard to the plank at two or more positions intermediate the length of the scaffold plank.

In a preferred aspect of the invention the lateral securing slots of the scaffold plank are elongated slots.

In a further aspect of the invention, the scaffold plank includes end securing slots provided centrally in opposed ends of the plank for cooperating with the toeboard mounting brackets to secure a toeboard to the end portion of aligned scaffold planks. Preferably, the end securing slots and the lateral securing slots are of the same configuration, and each end securing slot is provided in one of the end caps.

In yet a further aspect of the invention, the top surface and the side rail portions are integral and produced by bending of sheet material. Preferably, the end caps are of an extruded aluminum alloy or steel construction.

According to an aspect of the invention, the series of lateral securing slots include two pairs of securing slots with each pair having opposed slots positioned on opposite sides of the plank an equal first distance from an adjacent end of the plank and the end securing slot in the adjacent end of the plank is spaced from the sides of the plank the same equal first distance.

In a preferred scaffold plank, the end securing slots are spaced from lateral sides of the plank a first distance and the series of lateral securing slots include on each side of the plank lateral securing slots spaced the same first distance from adjacent ends of the plank. Preferably, the lateral securing slots on each side of the plank include a pair of securing slots adjacent a center of the plank relative to the length thereof having a shorter spacing therebetween than the spacing with the adjacent lateral securing slots.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
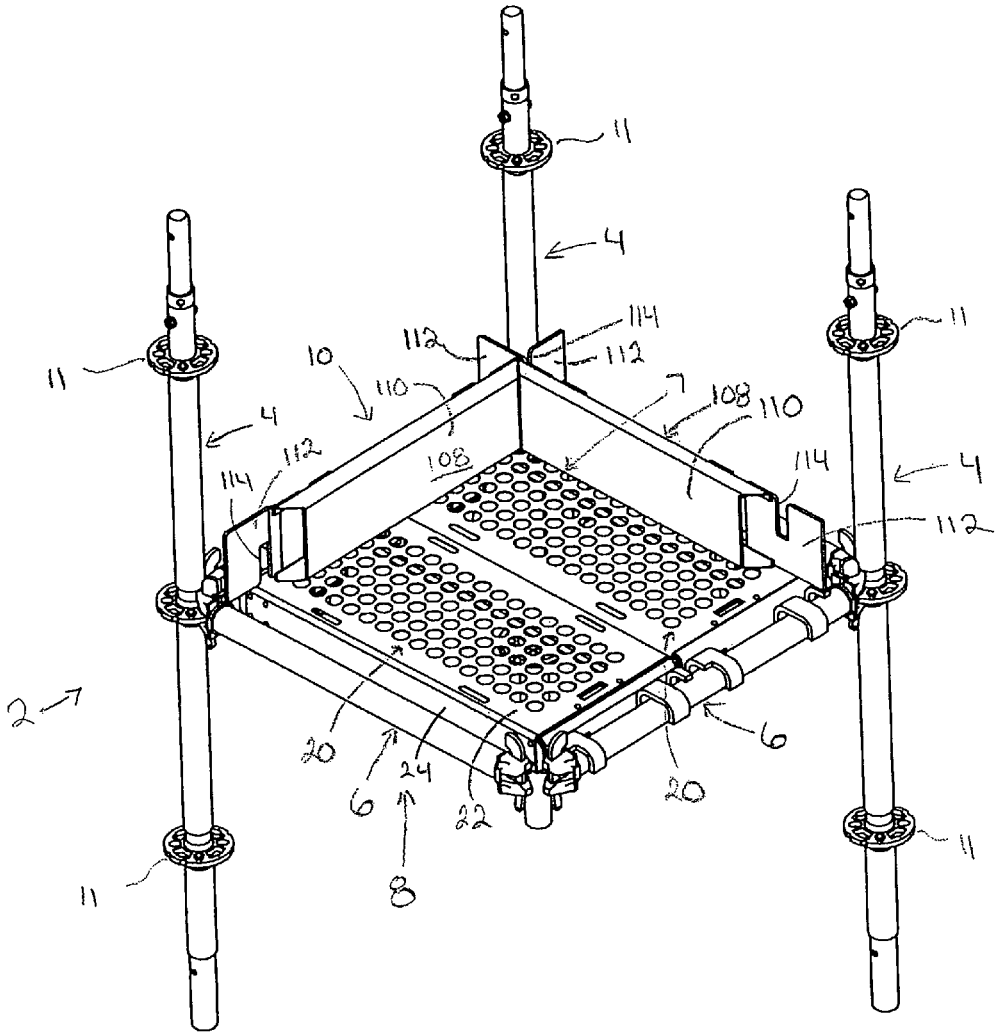
FIG. 1 is a partial perspective view of a scaffold illustrating the plank and toeboard system.
Figure 2:
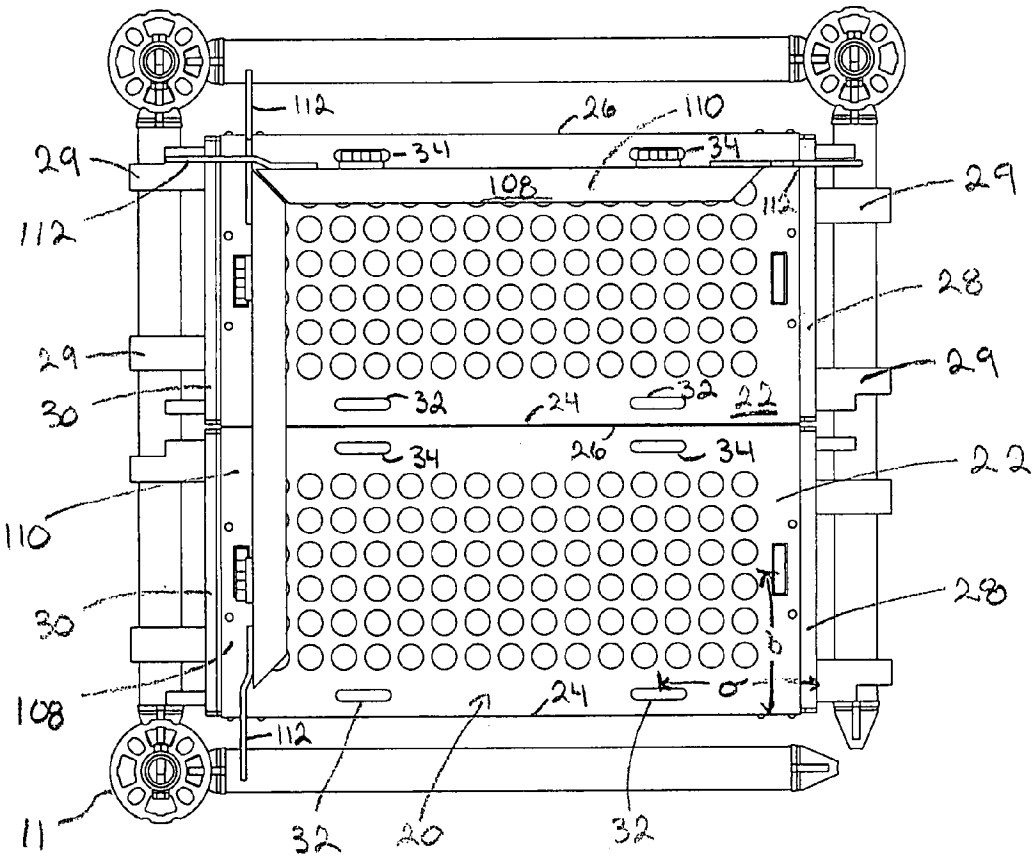
FIG. 2 is a top view of FIG. 1.

The scaffolding system 2 is partially shown in FIGS. 1 through 4 and 6 through 9, and includes a number of uprights 4 and connected ledgers 6 to define a bay 7 having a bay length 8 and a bay width 10. The scaffold system also includes a number of diagonal braces (not shown) connected to the rosettes 11 to brace adjacent uprights. In North America, the typical bay has a width of five feet, and a predetermined modular length of up to ten feet. Bay lengths of five and seven feet (defined by the ledgers 6) are also common to allow the scaffold to be adjustable to meet different physical requirements of the installation. Scaffold planks 20 are typically designed for particular bay lengths, and are designed for providing a working platform in any bay.

FIGS. 1 through 4 and FIGS. 6 and 7 show the preferred scaffold plank 20 having a top surface 22, opposed side rail portions 24 and 26, with end caps 28 and 30 provided at opposite ends of the scaffold plank. The end caps 28 and 30 include hooks 29 for securing the scaffold plank on opposed ledgers. In a preferred metal scaffold plank 20 (shown in FIG. 1) the top surface and the side rail portions are manufactured from a common sheet material to provide a ported reinforced top surface 22 and is bent to form the side rail portions 24 and 26. Thus, the top surface is integrated with the side rail portions 24 and 26. The end cap members 28 and 30 are typically of an extruded aluminum, or assembled from various steel or aluminum components. The end caps are inserted below the top surface 22, and typically engage the side rails to provide a strong mechanical connection therebetween.

Figure 4:
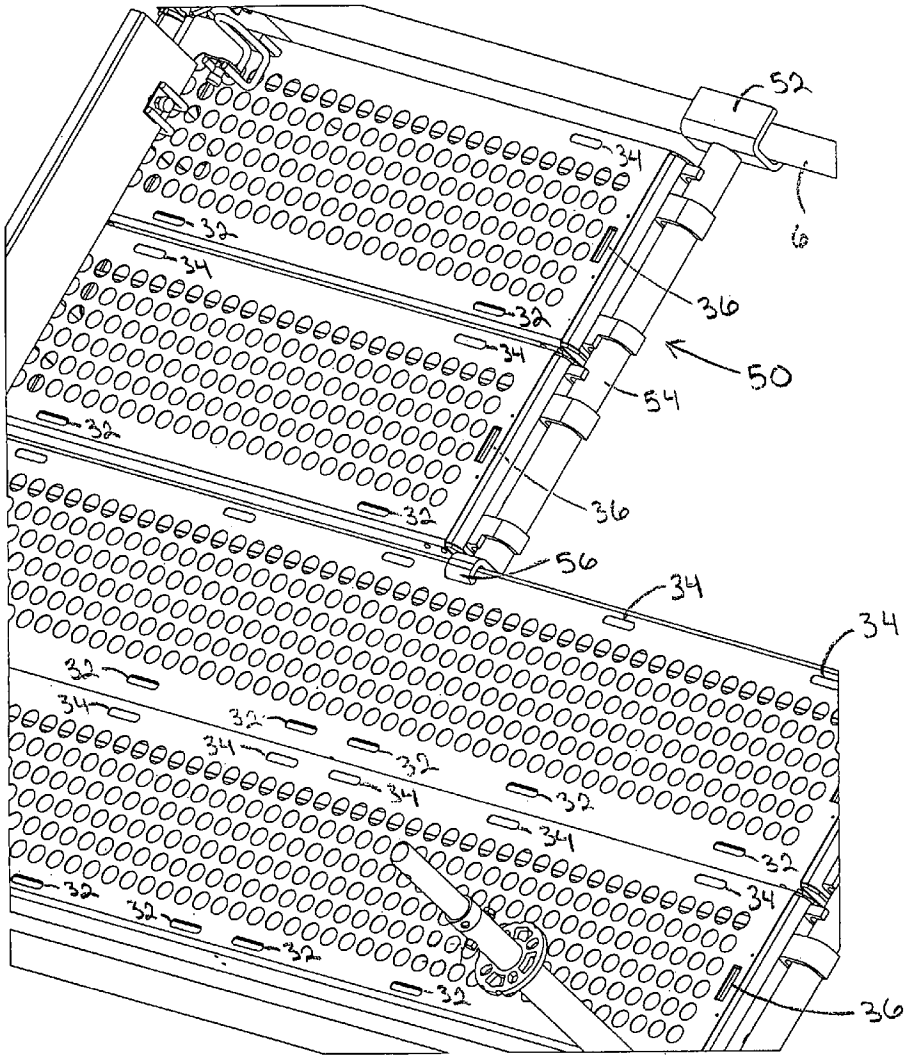
FIG. 4 is a partial perspective of the plank and toeboard system and an intermediate plank ledger.
Figure 5:
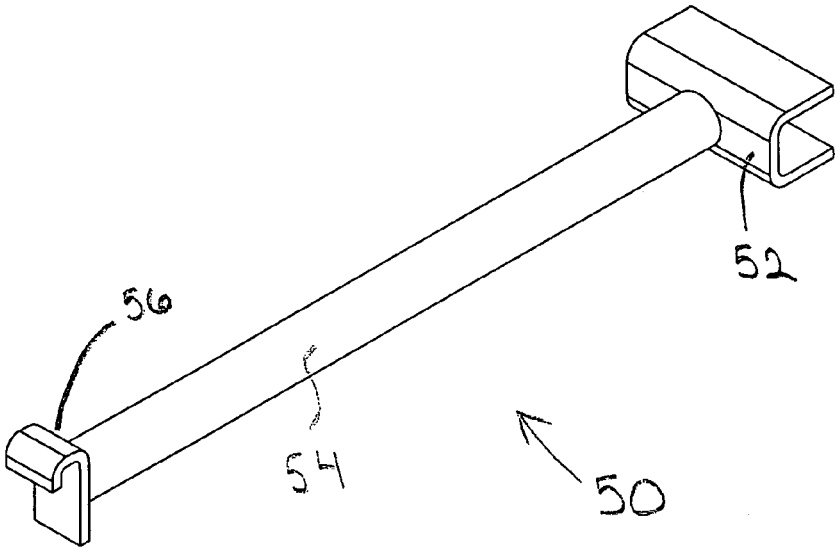
FIG. 5 is a perspective view of the intermediate plank ledger.

A series of lateral securing slots 32 are provided on one side of the scaffold plank 20 with a series 34 of lateral securing slots provided on the opposite side. As shown in FIG. 4, each of these series of lateral securing slots include three or more slots, and in the preferred ten foot scaffold plank, include six securing slots. The scaffold plank 20 also includes an end securing slot 36 provided in one end of the plank, and an end securing slot 38 provided in the opposite end of the plank. Preferably, each of the end securing slots 36 and 38 are centrally located, and are a specific distance (a) from the sides of the plank. The first lateral securing slot (i.e. the lateral securing slot closest to an associated end securing slot) is spaced from the end of the scaffold plank of the same distance (a) (see FIG. 2). This arrangement allows for modularity when a toeboard is secured to the ends of the plank or to the sides of the plank. The toeboards will not be physically connected to the plank at the ends, but will be spaced a short distance either in the width of the plank or in the length of the plank. Also, the distance between lateral securing slots is preferably a multiple of this distance.

Figure 3:
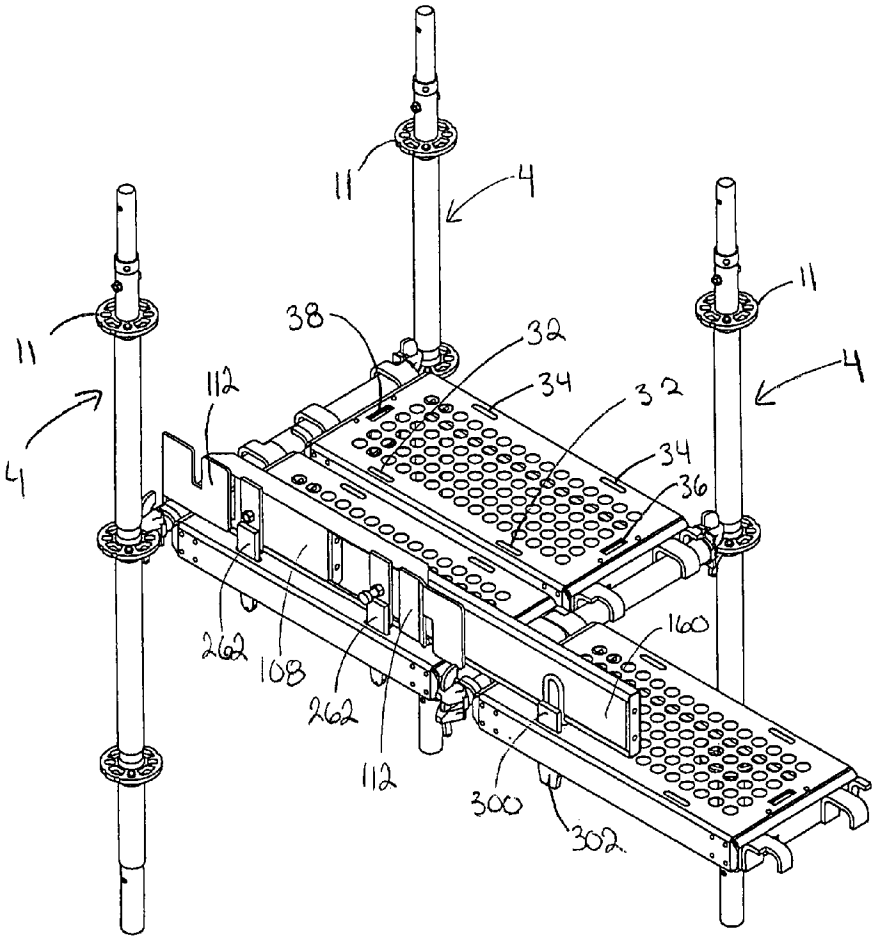
FIG. 3 is a partial perspective view illustrating a telescopic toeboard extension.
Figure 7:
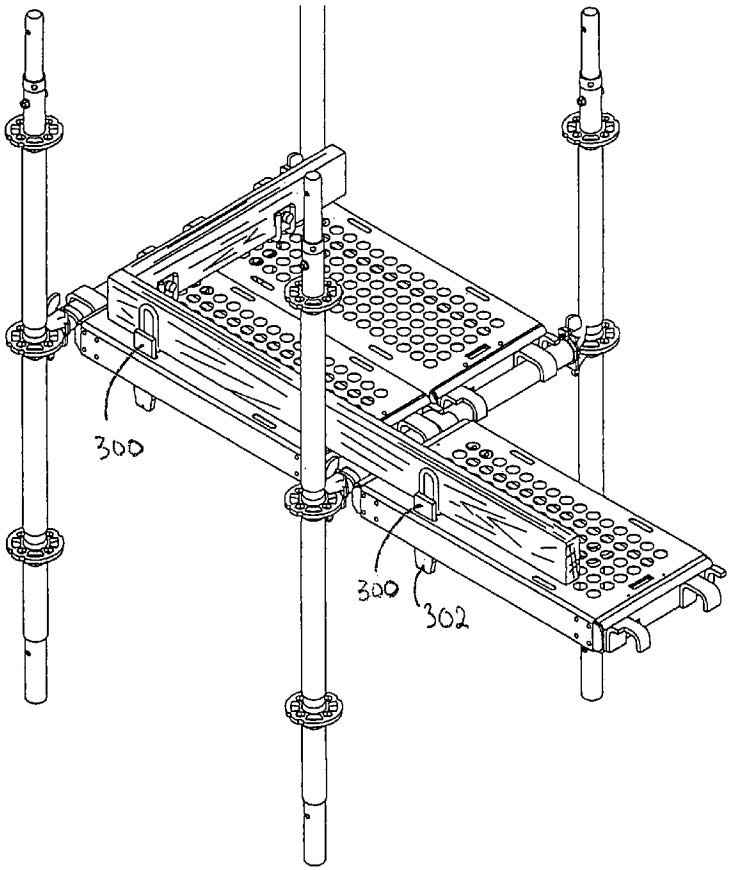
Figure 8:
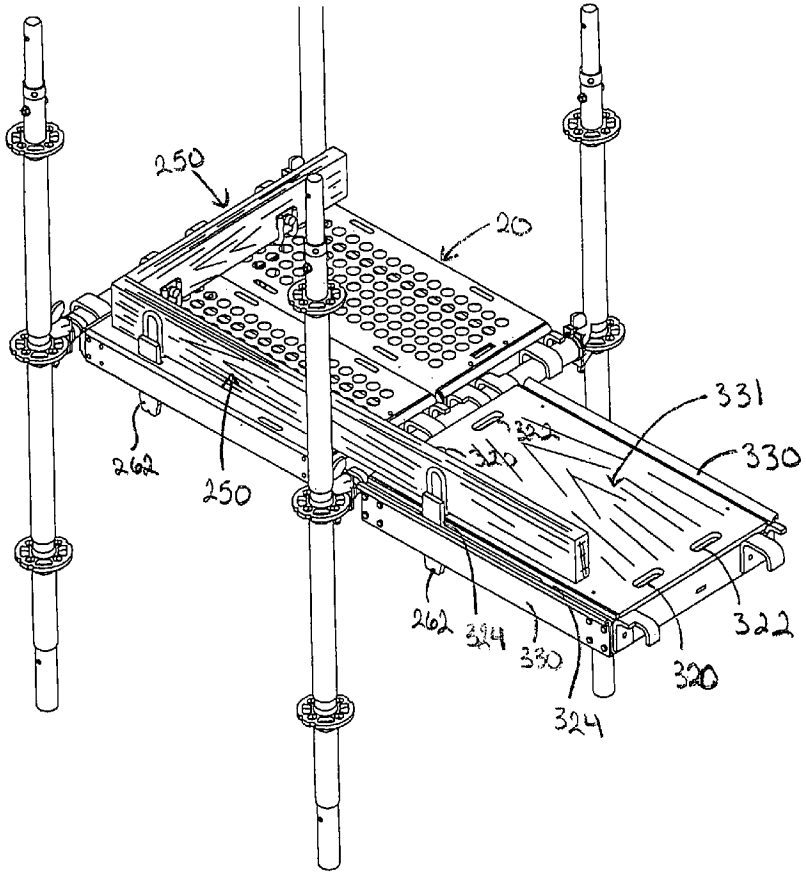
FIG. 8 is a partial perspective view of the system with two different types of decking planks.
Figure 10:
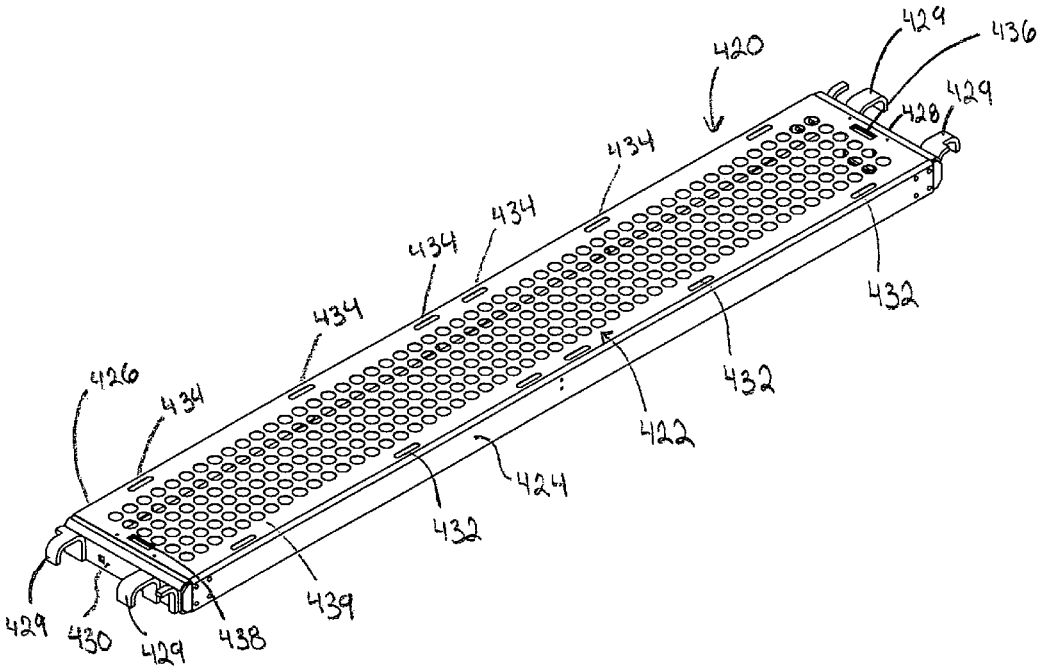
FIG. 10 is a perspective of a scaffold plank.
Figure 11:
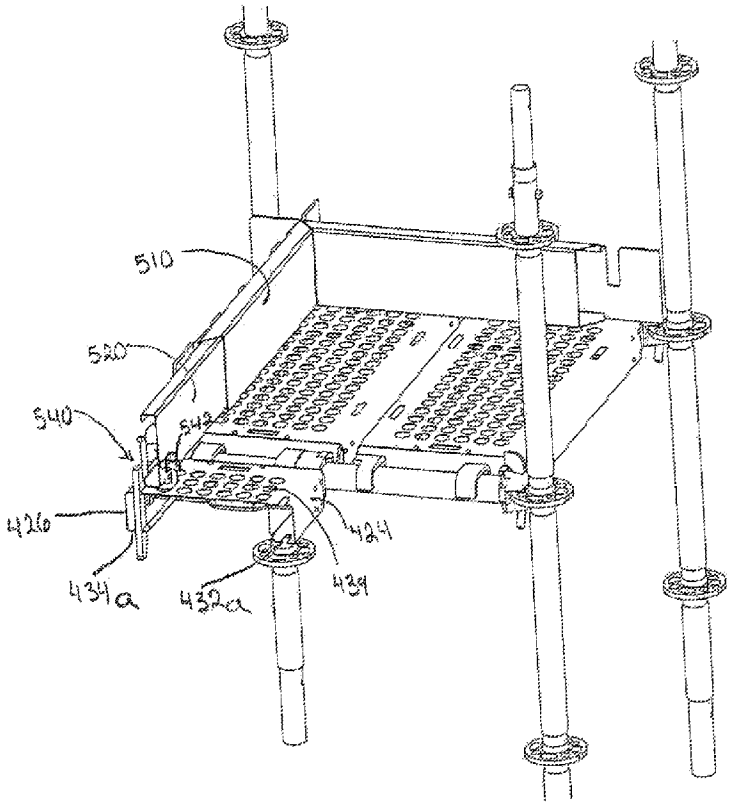
FIG. 11 is a partial perspective of a scaffold system with a sectional view through a scaffold plank.
Figure 12:
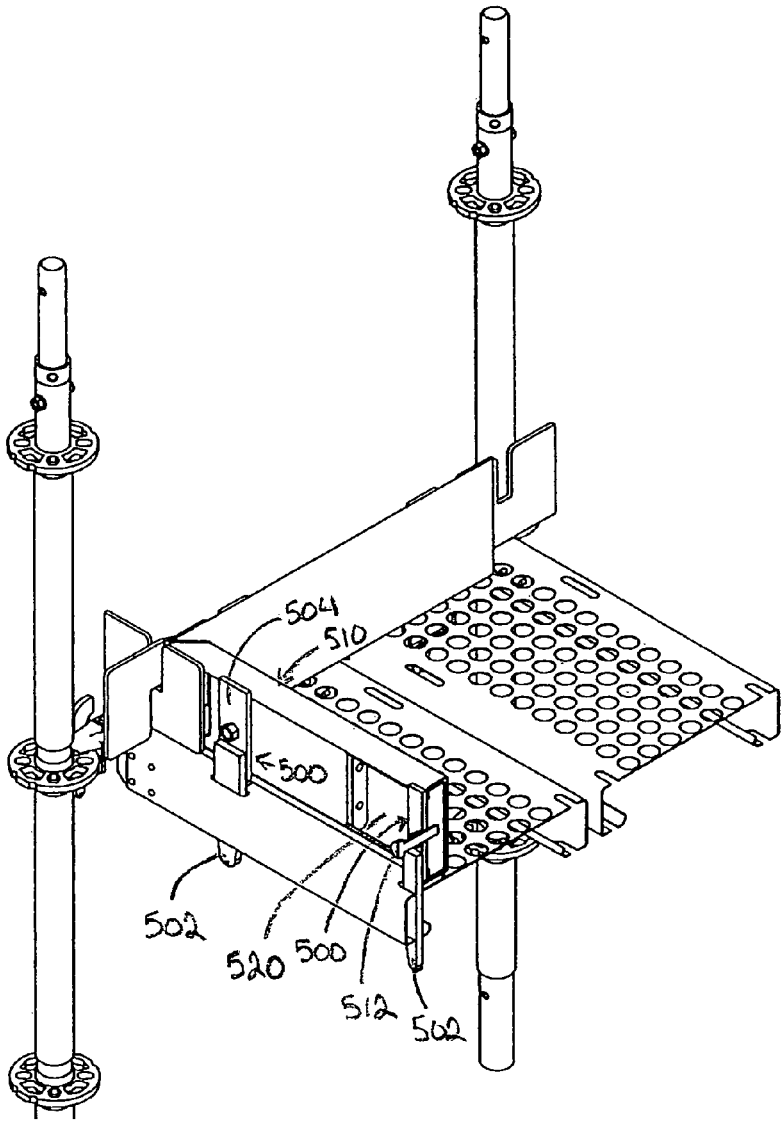
FIG. 12 is a partial perspective view illustrating a section through two scaffold planks.
Figure 13:
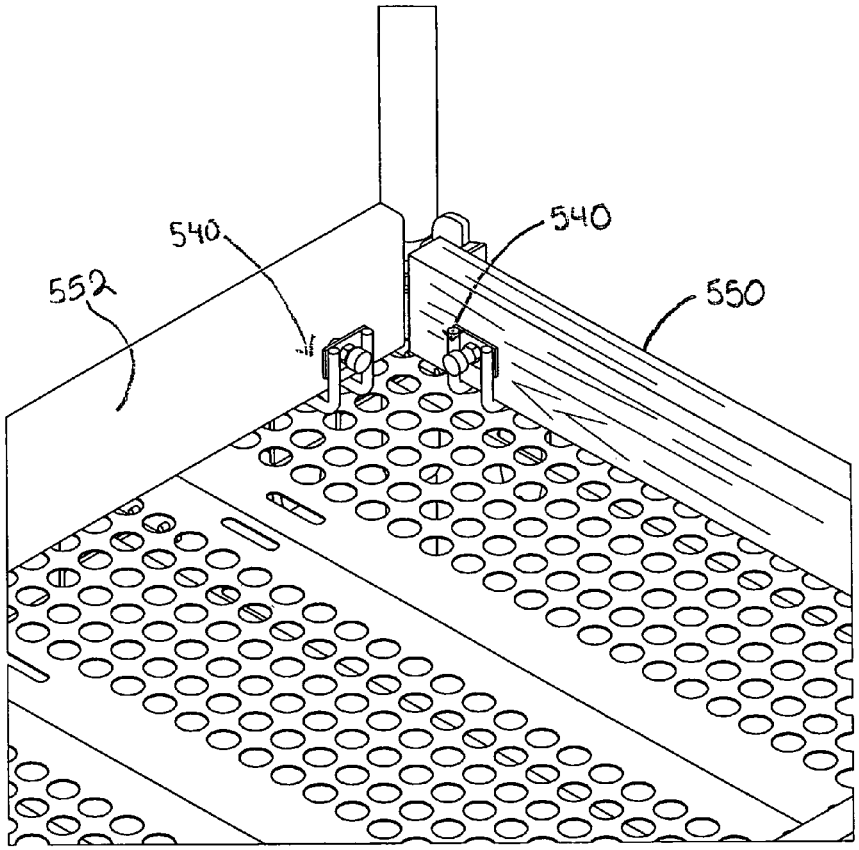
FIG. 13 is a partial perspective view of a work platform with two different types of toeboards.
Figure 14:
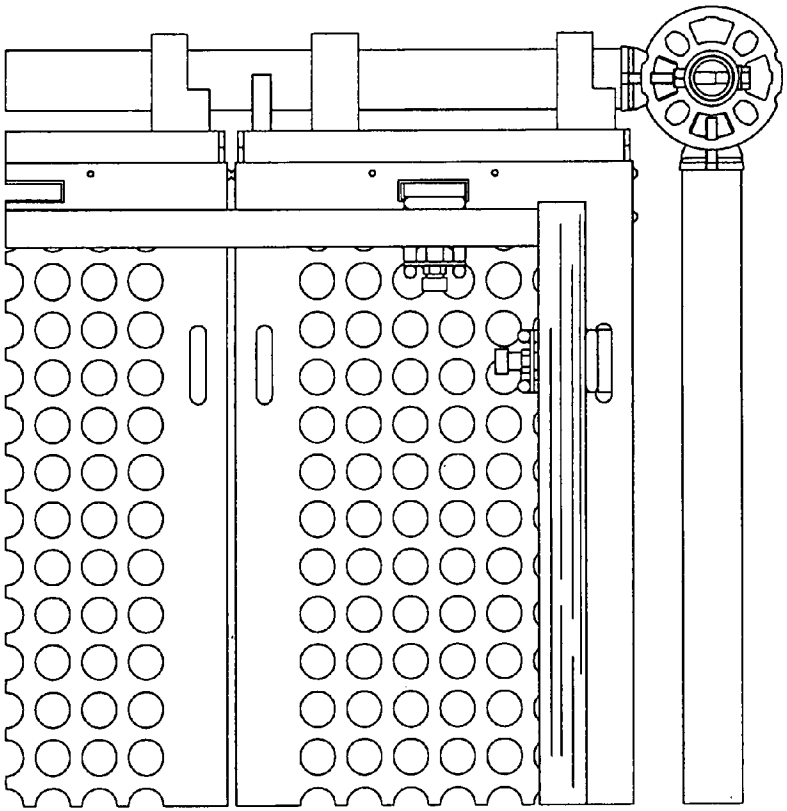
FIG. 14 is a top view of the work platform of FIG. 13.
Figure 15:
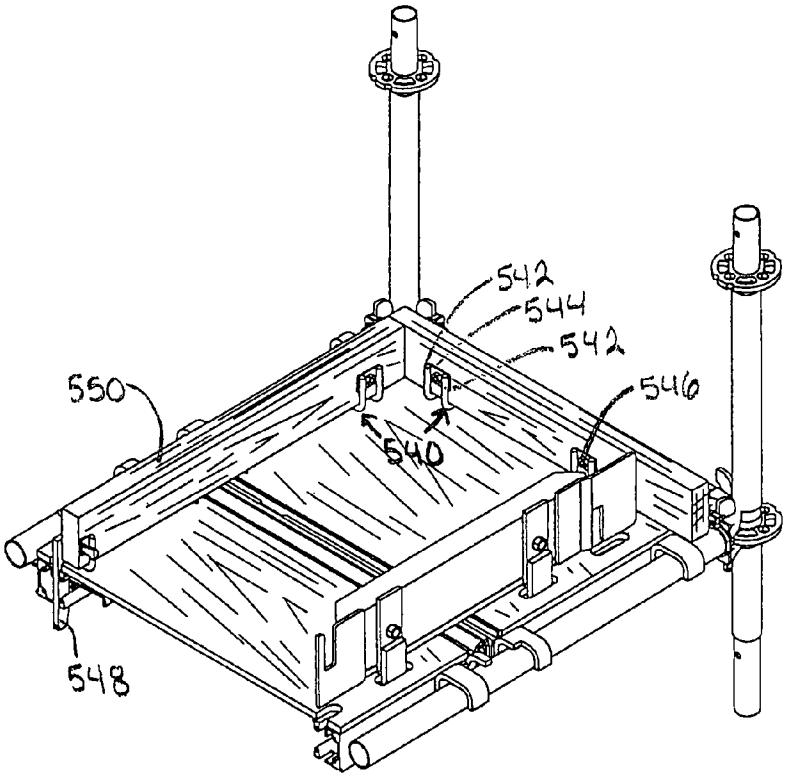
FIG. 15 is a partial perspective view of a work platform.

The lateral securing slots 32 and 34 are provided in the top surface of the scaffold plank and extend downwardly and allow engagement of a toeboard mounting bracket 100 with the underlying side rail portion. Preferably, the side rail portion includes a slot in its lower surface to allow a mounting bracket to pass therethrough as shown in FIGS. 3, 7 and 8. FIG. 10 shows upper securing slots 432 and 434 and FIG, 11 shows corresponding aligned lower securing slots 432*a* and 434*a*. Each upper and lower securing slot pair forms a securing position for receiving a male component 302 of a toeboard mounting bracket 300.

One of the advantages of the scaffold plank as disclosed and shown in the drawings is the ability to provide an end support for intermediate plank ledger 50. Intermediate plank ledger 50 includes a "U"-shaped securing member 52 that can slide along and engage a ledger 6 as shown in FIG. 4. The intermediate plank ledger also includes a tube portion 54 with the plank engaging hook 56 at one end thereof. With this arrangement, the intermediate plank ledger is connected to a ledger 6 using the U-shaped connector 52, and is rotated downwardly and can be moved along the ledger such that the plank engaging hook 56 is located for engaging one of the securing ports in a side of the plank. In this way, an intermediate support for a shorter plank can be provided in any bay to accommodate an upright structure that is passing through the scaffold. For example, a series of pipes or a column support for a building may require the scaffold to be built around this structure. Shorter scaffold planks 20*a* (see FIG. 6) can be used and the end securing slots allow for securement of a toeboard. Similarly, a toeboard 79 can be provided as shown at 80 on the partial length of the longer plank 20*b*. Thus a toeboard can easily be provided around the perimeter of an upright portion that is extending through the scaffold.

Various arrangements for toeboards are shown in the drawings. In the preferred embodiment (FIGS. 1 through 3), the toeboards 108 are of a fabricated metal construction having a central portion 110 and two flat end portions 112. Each of these end portions include a securing slot 114 for engaging a like toeboard in a perpendicular interlocking arrangement as shown in FIG. 1. If the toeboards are used in an end to end manner, these connecting portions effectively overlap and also partially engage to avoid tools being inadvertently dropped. Thus, the toeboards allow effective overlap of members 112 at adjacent ends.

A number of mounting brackets 300 are also shown, where the mounting brackets allow a contractor to use existing materials for forming toeboard systems. The mounting brackets 300 include a male component 302 for non-rotatably engaging any of the securing slots (32, 34, 36, 38) either lateral or in the end portion, and typically these brackets include a "U"-shaped slot for receiving a toeboard such as a wooden toeboard or a metal channel. These materials are commonly available on site and the brackets allow effective use of these common materials. Contractors often prefer to merely fabricate toeboards onsite rather than purchase a system of toeboards. The mounting brackets 300 when received in a plank automatically align the "U"-shaped slot for receiving a toeboard. This arrangement simplifies installation.

Figure 6:
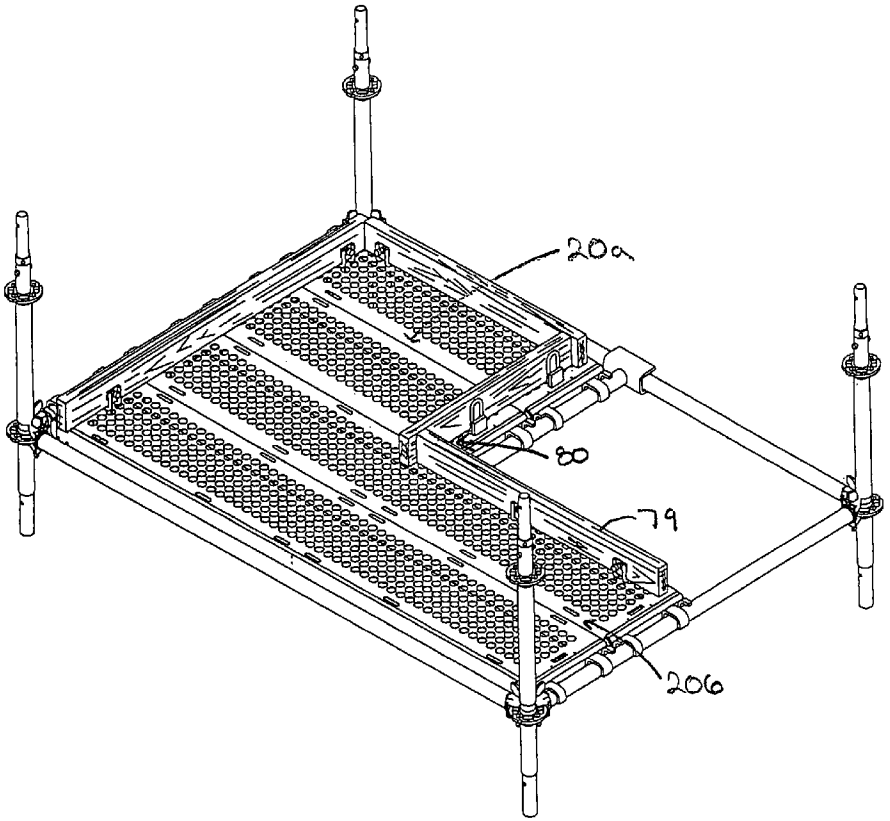
FIGS. 6 and 7 are partial perspective views of the plank system with toeboard brackets supporting wood toeboards.
Figure 9:
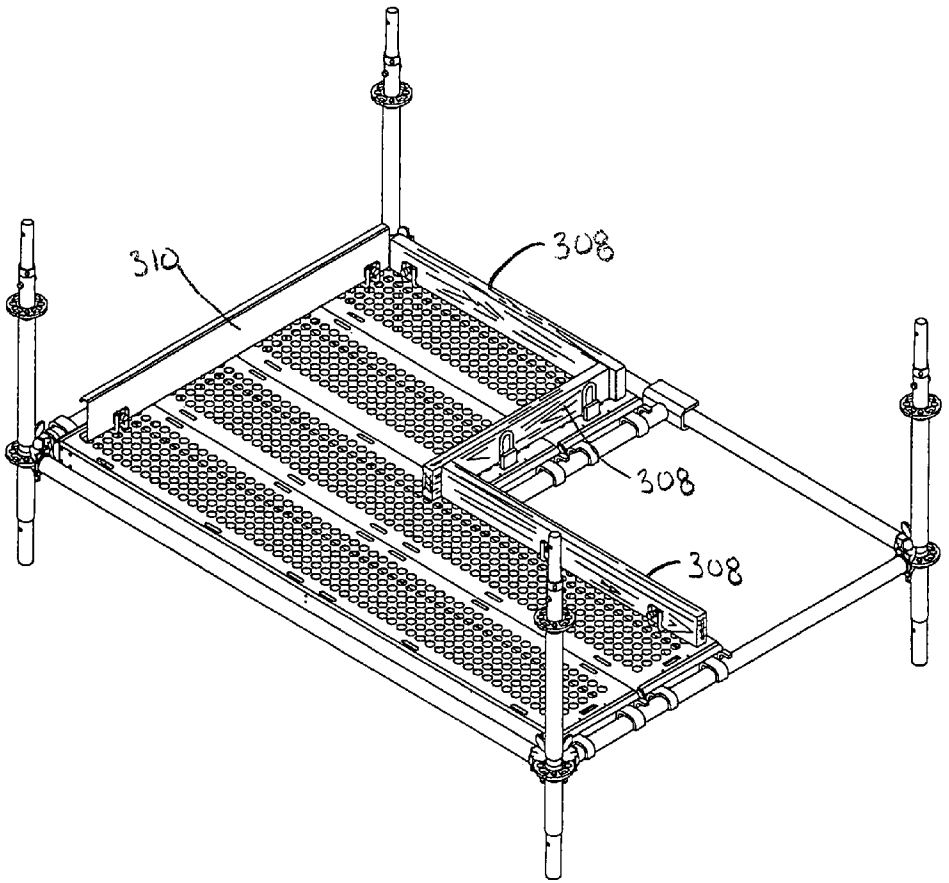
FIG. 9 is a partial perspective view of the plank and toeboard system using two different toeboards.

Contractor fabricated toeboards are shown in FIGS. 6, 7 and 8. FIG. 9 shows a wooden toeboard 308 and a metal contractor fabricated toeboard 310 both secured by brackets. FIG. 8 illustrates the toeboard and plank system using two different types of planks. One bay has planks 20 whereas the adjacent bay shows a wider (19 inch) plywood deck 331 also having the securing ports 320 and 322 in the ends of the deck and securing ports 324 provided in siderails 330.

In the system toeboards of FIGS. 8 and 9, the toeboard 250 includes a series of downwardly extending male projections 262 that are positioned for engaging the lateral securing slots or the end securing slots in aligned scaffold planks. The toeboards are easily dropped in position for securing of the toeboard about the periphery of a bay as required and for cooperation with adjacent bays.

The following features of the toeboard and scaffold plank can be appreciated from a review of the drawings.

1) The toeboards are secured to the planks and not the vertical posts of the scaffold. With this arrangement the width of the planking can vary relative to the width of the scaffold bay and the toeboards can be appropriately secured to protect the exposed edges of the working platforms.
2) System toeboards can be used and the system toeboards accommodate the use of an inner sliding channel in order to allow the system to accommodate make-up bays. The inner sliding channels are available in pre-determined lengths and can be used elsewhere as system toeboards located and fixed to the planks using drop-in securing brackets.
3) The system is designed for use with a pre-engineered toeboard system, a knock-down system or by fabrication on site. This knock down system can be made from pre-engineered steel "C"-channels and brackets, or even wooden toeboards that are fixed to the planks using the same brackets as those that fix the steel channels. No such mix and match solution has been offered before.
4) The planks have slots in pre-determined positions. These slots occur at each end of the plank and also close to the ends on the longitudinal upper edges of the planks. These slots accommodate the tongues of the system toeboard units, or brackets. They may also be used to fix other decking accessories. No other system has introduced planks that provide fixing slots at predetermined modular positions.
5) The slots along the length of the plank are in predetermined positions and allow the attachment and location of an intermediate plank support. This member spans between the outer plank and the outer longitudinal ledger of the scaffold frame work. Because the slots are located 5 feet, 7 feet or other modular lengths from either end of the plank, system planks can be used that have one end supported by the intermediate plank support and the other by the scaffold framework. Though intermediate supports are often used in the scaffold business, they are not located in position, nor retained by slots in the plank system.
6) Because the toeboards are not attached to the scaffold framework, openings in the middle of platforms (that are not close to any vertical scaffold members) can be surrounded by toeboards and are rendered much safer because there are a multitude of slots in the plank system. It is highly likely that every edge of any such opening, in the scaffold platform, would have at least two slots to fix system toeboards of the knock-down toeboard brackets into them.
7) Where wood toeboards have been chosen, due to cost or convenience, the users can fit the toeboard brackets into the slots in the planks almost anywhere. This means that almost any length of wood could be used. This avoids lapping and wiring.
8) Like other system solutions, the toeboard units can be used longitudinally and at the ends of scaffolds.
9) The slots in the planks could also be used as a bottom connection for a single guardrail that has an integral toeboard unit. The top part would be secured to the scaffold posts and the bottom retained by the slots in the planks. Of course, this solution would rely on the close proximity of the outer planks to the vertical posts of the scaffold.
10) The slots at the side and ends of the planks also provide fixing points for infill plates that cover any gaps at the end and between planks. No such fixing has hitherto been possible.
11) Aluminum and plywood decks are also available with slots that are located at the same position as the steel planks. The aluminum side rail has been specifically designed so that the slots do not interfere with the decking along the length, the end slots do pass through the decking member, whether this is steel plate or plywood.
12) In order for the toeboard system to work efficiently, the decks or planks are aligned and the hooks on the planks are designed to mesh together and maintain the alignment of each plank longitudinally. Laterally, the ledger heads at each end of the scaffold system retain the planks in this direction, although this is only necessary where end toeboards are fitted to the platform.
13) The locating tongues, on the system toeboard units, are tapered where they pass through the slots in the plank. This taper enables the toeboard to be lifted upwards to allow the fitting of the last toeboard of a square platform, that is totally bordered by toeboards.

With the present system, a unique scaffold plank has been disclosed that provides securing slots (either lateral along the edges of the securing plank, or in the end portions of the securing plank) which allow toeboards to be effectively secured at positions spaced from end corners of the plank. The series of lateral securing slots are provided at different points in the length of plank and also cooperate with a plank support tube that is slidable along a ledger and can be positioned for engaging in one of these ports. This provides a simplified arrangement for convenient support of planks which do not extend the full length or width of a bay.

Although various preferred embodiments of the present invention have been described herein in detail, it will be appreciated by those skilled in the art, that variations may be made thereto without departing from the scope of the appended claims.

The embodiments of the invention in which an exclusive property or privilege is claimed are defined as follows:

1. A scaffold plank comprising a plank body of a single unitary piece of material, and end caps secured to opposite end of said plank body; each end cap including spaced hooked portions extending outwardly from each end cap for supporting said scaffold plank from horizontal members of a scaffold; said plank body having a top work surface and opposed downwardly extending side rails supporting said top work surface between said opposed side rails; each side rail extending between said opposite ends of said plank body and each side rail extending downwardly from said top work surface; each side rail including a lower edge terminating in an inwardly extending stub flange; said opposed end caps overlapping with said side rails and said top work surface at said opposite ends of said plank body and said opposed end caps being mechanically secured thereto reinforcing each end of said scaffold plank; each side rail including at least three securing positions distributed between said end caps; each securing position having an upper slot extending through said top work surface and a vertically aligned lower slot extending through said inwardly extending stub flange so that both slots of each respective securing position are configured to support a toeboard; wherein each of said upper slots and vertically aligned lower slots define an elongate opening having a major axis that extends in a direction between said end caps, wherein said direction is parallel to a major length of said side rails; wherein one of said at least three securing positions with respect to each side rail in centrally located between said end caps of scaffold plank; and wherein each of said opposite ends of said plank body includes an end securing position having an elongated end securing slot with a major axis extending in a perpendicular direction with respect to the major length of said side rails, the end securing slot configured to receive the support member of the toeboard mounting bracket.

2. The scaffold plank as claimed in claim 1 wherein each end securing slot is the same size of said upper and vertically aligned lower slots.

3. The scaffold plank as claimed in claim 1 wherein said top work surface and said side rails are of a metal sheet material and said top work surface is perforated to provide a grip surface.

4. The scaffold plank as claimed in claim 1 in combination with an intermediate ledger, said intermediate ledger having one end with a downwardly extending projection receivable in said upper and lower securing slots of any of said securing positions and an opposite end with a "U" shaped channel connectable to a ledger.

5. The scaffold plank as claimed in claim 2 wherein securing positions of said side rails are arranged in a directly opposed manner on either side of said scaffold plank.

6. The scaffold plank as claimed in claim 1 wherein said at least three securing positions is at least five securing positions.

7. The scaffold plank of claim 1 in combination with a scaffold system and a series of said toe board mounting bracket.

8. An intermediate ledger in combination with a scaffold plank comprising a plank body of a single unitary piece of material, and end caps secured to opposite ends of said plank body; each end cap including spaced hooked portions extending outwardly from each end cap for supporting said scaffold plank from horizontal members; said plank body having a top work surface and opposed downwardly extending side rails supporting said top work surface between said opposed side rails; each side rail extending between said opposite ends of said plank body and each side rail extending downwardly from said top work surface; each side rail including a lower edge terminating in an inwardly extending stub flange; said opposed ends of said plank body and said opposed end caps being mechanically secured thereto reinforcing each end of said scaffold plank; each side rail including at least three securing positions distributed between said end caps; each securing position having an upper slot extending through said top work surface and a vertically aligned lower slot extending through said inwardly extending stub flange so that both slots of each respective securing position are configured to simultaneously receive a support member of a toeboard mounting bracket configured to support a toeboard; wherein each of said upper slots and vertically aligned lower slots define an elongate opening having a major axis that extends in a direction between said end caps, wherein said direction is parallel to a major length of said side rails; wherein one of said at least three securing positions with respect to each side rail is centrally located between said end caps of said scaffold plank; and said intermediate ledger having one end with a downwardly extending projection removably received in one of said securing positions, and said intermediate ledger having an opposite end with a "U" shaped channel connectable to a ledger.

* * * * *